US005876911A

United States Patent [19]

Nakajima et al.

[11] Patent Number: 5,876,911

[45] Date of Patent: Mar. 2, 1999

[54] SILVER HALIDE PHOTOGRAPHIC PHOTOSENSITIVE MATERIAL AND ITS PRODUCTION

[75] Inventors: Kenji Nakajima; Shouji Nishida, both of Kanagawa, Japan

[73] Assignee: Fuji Photo Film Co., Ltd., Kanagawa, Japan

[21] Appl. No.: 863,205

[22] Filed: May 27, 1997

[30] Foreign Application Priority Data

May 27, 1996 [JP] Japan ..... 8-131987

[51] Int. Cl.[6] ..... G03C 1/81; G03C 1/93

[52] U.S. Cl. ..... 430/536; 430/523; 430/531; 430/533; 430/534; 430/535; 430/539; 430/930

[58] Field of Search ..... 430/523, 531, 430/536, 539, 930, 533, 534, 535

[56] References Cited

U.S. PATENT DOCUMENTS

| | | | |
|---|---|---|---|
| 3,752,692 | 8/1973 | Young | 430/215 |
| 5,219,718 | 6/1993 | Hatakeyama et al. | 430/523 |
| 5,227,285 | 7/1993 | Hattori et al. | 430/930 |
| 5,334,482 | 8/1994 | Aono | 430/215 |
| 5,554,494 | 9/1996 | Shiratsuchi | 430/531 |

FOREIGN PATENT DOCUMENTS

| | | |
|---|---|---|
| A-0514903 | 11/1992 | European Pat. Off. . |
| A-8-69084 | 3/1996 | Japan . |

*Primary Examiner*—Richard L. Schilling
*Attorney, Agent, or Firm*—Sughrue, Mion, Zinn, Macpeak & Seas, PLLC

[57] ABSTRACT

This invention provides a means for improving rapid drying ability upon development and preservability of developing solution which comprises interposing a layer of water-soluble polymer having an average molecular weight of 300,000 or more between a non-photosensitive hydrophilic colloid layer and a hydrophobic polymer layer coated on the opposite side of a support to a silver halide photographic emulsion layer, or storing dried the above silver halide photographic photosensitive material with the interposed layer at the glass transition temperature of the hydrophobic polymer or higher.

9 Claims, No Drawings

SILVER HALIDE PHOTOGRAPHIC PHOTOSENSITIVE MATERIAL AND ITS PRODUCTION

BACKGROUND OF THE INVENTION

This invention relates to a silver halide photographic photosensitive material, especially having rapid drying ability upon development and preservability of developing solution, and producing the same.

Recently, preservability of developing solution and rapid treating ability upon development are required in silver halide photographic photosensitive materials.

A method of improving the preservability and rapid treating ability is to render the opposite side (back surface) of a support having a silver halide photosensitive layer hydrophobic without coating a non-photosensitive colloid layer. However, in this method, the silver halide photographic photosensitive material cannot be prevented from deforming (curling) caused by the variation of humidity according to environment wherein the photosensitive material is placed.

A method of improving the preservability of developing solution and rapid development treating ability without curling problem of a silver halide photographic photosensitive material is disclosed in U.S. Pat. No. 5,219,718 corresponding to Japanese Patent KOKAI 5-232625 which comprises coating a non-photosensitive hydrophilic colloid layer and a hydrophobic polymer layer on the outside thereof. Furthermore, as a method of improving resistance to wounding of the hydrophobic polymer layer, to blend colloidal silica into the hydrophobic polymer layer is disclosed in Japanese Patent KOKAI 5-232626, and to blend a lubricant is disclosed in Japanese Patent KOKAI 6-19042.

However, the method of superposing the hydrophobic polymer layer on the non-photosensitive hydrophilic colloid layer and coating the support with them simultaneously has the following problems, although the method has a high productivity.

One problem is, when the hydrophobic polymer layer is superposed on the non-photosensitive hydrophilic colloid layer, the binder in the hydrophilic colloid layer diffuses into the hydrophobic polymer layer. As a result, water resistance of the hydrophobic polymer layer is degraded to lose preservability and rapid treating ability of developing solution.

Another problem is, in the case that the electric charge of the hydrophobic polymer is opposite to the hydrophilic colloid, the hydrophobic polymer is combined with the hydrophilic colloid by electrostatic interaction to form agglomerates upon superposing the hydrophobic polymer layer on the non-photosensitive hydrophilic colloid layer, and thereby, the coated layer loses clarity. Moreover, the coated layer is deformed to lose clarity in the drying process after applying the non-photosensitive hydrophilic colloid layer and the hydrophobic polymer layer onto the support.

SUMMARY OF THE INVENTION

The first object of the invention is to provide a means of producing a silver halide photographic photosensitive material capable of ensuring water resistance of a hydrophobic polymer layer upon applying a non-photosensitive hydrophilic colloid layer and a hydrophobic polymer layer with superposing thereon simultaneously onto the back face of a support of the silver halide photosensitive material, and capable of having preservability of developing solution and rapid development treating ability.

The second object of the invention is to provide a method of producing a silver halide photographic photosensitive material not inducing loss of clarity of coated layers upon applying a non-photosensitive hydrophilic colloid layer and a hydrophobic polymer layers with superposing thereon simultaneously onto the back face of a support of the silver halide photosensitive material, and capable of having preservability of developing solution and rapid development treating ability.

The first object of the invention has been achieved by a silver halide photographic photosensitive material which comprises a support, a silver halide photographic emulsion layer coated on one side of the support, and a non-photosensitive hydrophilic colloid layer and a hydrophobic polymer layer coated on the other side of the support locating the hydrophobic polymer layer on the outside, wherein a layer of water-soluble polymer having an average molecular weight of 300,000 or more is interposed between the non-photosensitive hydrophilic colloid layer and the hydrophobic polymer layer.

The first object of the invention has also been achieved by a method of producing a silver halide photographic photosensitive material which comprises applying a silver halide photographic emulsion layer coating solution containing hydrophilic colloid as binder onto one side of a support and applying a non-photosensitive hydrophilic colloid layer coating solution containing hydrophilic colloid as binder and a hydrophobic polymer layer simultaneously on the other side, and then drying, wherein the dried silver halide photographic photosensitive material is stored at glass transition temperature −20° C. of the hydrophobic polymer or higher.

The second object of the invention has been achieved by a method of producing a silver halide photographic photosensitive material which comprises applying a silver halide photographic emulsion layer coating solution containing hydrophilic colloid as binder onto one side of a support and applying a non-photosensitive hydrophilic colloid layer coating solution containing hydrophilic colloid as binder and a hydrophobic polymer layer simultaneously on the other side, and then drying, wherein pH relation is adjusted so that electric charge of the hydrophilic colloid particles of the non-photosensitive hydrophilic colloid layer becomes the same sign as the hydrophobic polymer, and drying wind in the drying process has a temperature difference between dry-bulb temperature and wet-bulb temperature is 7° C. or more.

In order to realize preservability of developing solution and rapid treating ability upon development, it is required that the hydrophilic colloid layer provided on the opposite side (back face) of a support where a silver halide photosensitive layer is not applied does not swell by developing solution. Thereupon, a technique was developed of preventing the developing solution from permeating the hydrophilic colloid layer by providing a hydrophobic polymer layer on the outside of the hydrophilic colloid layer on the back surface (U.S. Pat. No. 5,219,718). However, when the hydrophilic colloid layer and the hydrophobic polymer layer are provided simultaneously with superimposing them on the support (multilayer coating) in order to achieve high productivity, quality of products is damaged by the following phenomena. That is, when the hydrophobic polymer layer composed of a hydrophobic polymer aqueous dispersion is superimposed on the hydrophilic colloid layer, the binder in the hydrophilic colloid layer diffuses into the hydrophobic polymer layer, and becomes passages of water. Besides, in the case that the hydrophobic polymer layer is composed of an aqueous dispersion of hydrophobic polymer, the binder of the colloid layer adheres to the surface of the hydrophobic polymer particles which are dispersed in water to intercept fusion of the hydrophobic polymer particles. As a result, water resistance of the hydrophobic polymer layer is insufficient to fail preservability of developing solution and rapid treating ability of development.

On the other hand, when a layer containing a water-soluble polymer as binder is interposed between the hydrophilic colloid layer and the hydrophobic polymer layer, the water-soluble polymer layer intercepts the diffusion of the binder of the hydrophilic colloid layer into the hydrophobic polymer layer. As a result, water passages do not form in the hydrophobic polymer layer, and fusion of the hydrophobic polymer particles does not inhibited. Accordingly, the hydrophobic polymer layer can exhibit water resistance sufficiently.

In another aspect of the invention, water resistance is imparted to the hydrophobic polymer layer unless the water-soluble polymer layer.

When the support provided with the hydrophilic colloid layer and the hydrophobic polymer layer and then dried is stored at a temperature not so lower than the glass transition temperature of the hydrophobic polymer, i.e. at the glass transition temperature −20° C. or higher, fusion of the hydrophobic polymer particles gradually proceeds by molecular diffusion of the hydrophobic polymer. The binder of the hydrophilic colloid layer diffused in the hydrophobic polymer layer becomes in an island state dispersed in the hydrophobic polymer layer, and water resistance appears. The higher storing temperature than the glass transition temperature of the hydrophobic polymer is better, and the storing period necessary for the appearance of water resistance can be shortened. The storing may be carried out before or after applying the silver halide photographic emulsion layer to the opposite side of the support.

With respect to the loss of clarity problem, in the case that both of the hydrophilic colloid which the binder in the back layer and the binder in the polymer layer have dissociation groups and are ionic, it is possible that the hydrophilic colloid molecules and the polymer layer binder molecules agglomerate to lose clarity upon superposing the hydrophobic polymer layer onto the hydrophilic colloid layer. In order to avoid the agglomeration, it is necessary to adjust pH so that the sign of the electric charge of the hydrophilic colloid molecules and the polymer layer binder molecules are the same. For example, the polymer layer binder is an aqueous dispersion of a polymer containing an acid component, such as methacrylic acid, and the polymer layer is adjusted to a high pH in order to increase dispersibility. In such a case, the acid component is dissociated, and the polymer has negative charge. When an aqueous gelatin solution is used as the hydrophilic colloid of the back layer, the pH of the gelatin layer is necessary to be set higher than the isoelectric point of gelatin.

Moreover, upon drying gradually the support coated with the back layer of the hydrophilic colloid layer and the hydrophobic polymer layer, the hydrophobic polymer which is the outer layer is first dried to form membrane, and subsequently, the hydrophilic colloid layer is dried and contracted. At that time, the hydrophobic polymer layer is subjected to contraction force of the hydrophilic colloid layer and occasionally deforms by buckling to lose clarity. In order to prevent the occurrence of loss of clarity, it is necessary to dry the hydrophilic colloid layer at almost the same time of drying the hydrophobic polymer layer. That is, it is preferable to render the difference between dry-bulb temperature and wet-bulb temperature which relates to drying speed to 7° C. or more.

DETAILED DESCRIPTION OF THE INVENTION

The back layer is a layer containing hydrophilic colloid as the binder. Preferable hydrophilic colloids have an equilibrium moisture content and a moisture absorption rate similar to the binder of the silver halide photographic emulsion layer on the side of coating the silver halide emulsion layer in view of curling, and the most preferred one is gelatin.

The gelatin may be any one used in the photographic film field, such as limed gelatin, acid-treated gelatin, enzyme-treated gelatin, gelatin derivatives, modified gelatins, and so on. Suitable hydrophilic colloids other than gelatin include colloidal proteins, such as colloidal albumin and casein, sugar derivatives, such as agar, sodium alginate and starch derivatives, synthetic hydrophilic compounds, such as carboxymethyl cellulose, hydroxymethyl cellulose compounds, polyvinyl alcohol, poly(N-vinyl pyrrolidone and polyacrylamide, and so on.

To the back layer, various additives for photographic film others than the binder may be added, such as matting agent, surfactant, crosslinking agent, thickner, antiseptic agent, ultraviolet absorber, inorganic particles, e.g. colloidal silica, etc. Furthermore, the back layer may be blended with polymer latex. The polymer latex is an aqueous dispersion of water-insoluble polymer particles having a mean particle size of 20 to 200 $\mu$m, and a preferable blending amount is 0.01 to 1.0 part by weight, preferably 0.1 to 0.8 part by weight by weight against 1 part by weight of the binder. Illustrative of preferable polymer latexex are those of polymer having an alkyl ester, hydroxyalkyl ester or glycidyl ester of acrylic acid or an alkyl ester, hydroxyalkyl ester or glycidyl ester of methacrylic acid as monomer unit, and having an average molecular weight of 100,000 or more, particularly preferably 300,000 to 500,000.

Dispersion medium of the hydrophilic colloid layer coating solution is, in general, water, and a suitable concentration of hydrophilic colloid is 2 wt. % to 15 wt. %, preferably 4 wt. % to 10 wt. %.

The back layer may be single layer or composed of two or more layers. The thickness of the back layer is not limited, but set according to the type of photographic photosensitive material. However, it is desirable to correspond to or to be close to the thickness of the silver halide photographic emulsion layer in view of curling problem, and in general, a preferable thickness of the back layer is about 0.2 to 20 $\mu$m, particularly 0.5 to 10 $\mu$m. In the case that the back layer consists of two or more layers, the above thickness is the total thickness of the layers.

The back layer is rendered substantially water-resistant by coating the hydrophobic polymer layer. "substantially water-resistant back layer" means the thickness of the back layer after immersing in water at 25° C. for 1 minute is 1.5 times as thick as that before immersion or less, preferably 1.3 times or less.

The hydrophobic polymer layer is substantially water-resistant. "substantially water-resistant polymer layer" mean the thickness of the polymer layer after immersing in water at 25° C. for 1 minute is 1.2 times as thick as that before immersion or less, preferably 1.1 times or less.

Moreover, "substantially water-resistant" in a combination of the hydrophilic colloid layer and the hydrophobic polyme layer means the total thickness of the hydrophilic colloid layer and the hydrophobic polymer layer after immersing in water at 25° C. for 1 minute is 1.5 times as thick as that before immersion or less, preferably 1,3 times or less. The increase in the total thickness (thickness by swelling) after the immersion in water is 2 μm or less, preferably 1 μm or less. Actually, the thickness by swelling at the finish of developing treatment is 2 μm or less, preferably 1 μm or less. Although there are various developing treatment conditions according to the type of photosensitive material, treating system and etc., in any event, the thickness by swelling cannot keep small unless water resistance at 25° C. appears.

The binder in the hydrophobic polymer layer may be any one capable of rendering the combination of the hydrophilic colloid layer and the hydrophobic polymer layer "substantially water-resistant". Illustrative of the binders are polyethylene, polypropylene, polystyrene, polyvinyl chloride, polyvinylidene chloride, polyacrylonitrile, polyvinylacetate, urethane resin, epoxy resin, fluoro resin, rubbers, such as butaciene rubber, chloroprene rubber and natural rubber, water-insoluble polymers of acrylic acid ester or methacrylic acid ester, such as polymethyl methacrylate and polyethyl acrylate, and derivatives thereof. The binder may be homopolymer composed of one type monomer or copolymer composed of two or more type monomers. Two or more binders may be combined.

To the hydrophobic polymer layer, various additives for photographic film may be added, such as matting agent, surfactant, crosslinking agent, viscous material, UV absorber, inorganic particles, e.g. colloidal silica, etc.

The polymer layer may be single layer or composed of two or more layers. The thickness of the polymer layer is not limited, but there is a preferable range. That is, when the thickness is thinner than the preferable range, water resistance of the polymer layer is insufficient resulting in the occurrence of swelling upon immersing in developing solution. On the other hand, when the thickness is thicker than the preferable range, water vapor permeability of the polymer layer is insufficient. As a result, absorption and desorption of moisture from the hydrophilic colloid layer are inhibited to induce curling caused by unbalance with the expansion or contraction of the silver halide emulsion layer. Although the preferable range of the polymer layer thickness depends on the type of the binder etc., in general, the range is 0.05 to 10 μm, more preferably 0.1 to 5 μm. In the case that the polymer layer consists of two or more layers, the above thickness is the total thickness of the layers.

Dispersion medium of the hydrophobic polymer layer coating solution is, in general, water, and a suitable concentration of hydrophobic polymer is 1 wt. % to 50 wt. %, preferably 5 wt. % to 30 wt. %.

Suitable water-soluble polymers used as the binder in the inetermediate layer imparting water resistance to the hydrophobic polymer layer are water-soluble sysnthetic polymers, such as polyvinyl alcohol, polyacrylamide, polyethylene glycol, water-soluble polyester, water-soluble nylon, water-soluble acrylate or methacrylate ester polymer, polyvinylamine derivative and polyvinyl pyrrolidone, natural or semi-synthetic polymers, such as cellulose derivatives including hydroxyethyl cellulose and carboxymethyl cellulose, and starch derivatives.

The water-soluble polymer used as the binder in the intermediate layer must have a great molecular weight in order to form diffusion barrier, and a suitable lower limit of the average molecular weight is 300,000. The upper limit is the upper end capable of exhibiting water solubility, preferably 2,000,000, more preferably 1,000,000, particularly preferably 500,000. A suitable thickness of the water-soluble polymer layer is in the range of substantially not lowering production rate cause by the increase of drying load, and actually 2 μm or less, preferably 1 to 0.02 μm, more preferably 0.5 to 0.1 μm.

To the intermediate layer, various additives may be added, e.g. adsorbent such as colloidal silica for trapping hydrophilic colloid molecules diffused from the hydrophilic colloid layer, crosslinking agent such as metal ion for crosslinking hydrophilic colloid molecules rapidly to inhibit diffusion into the hydrophobic polymer layer.

Dispersion medium of the intermediate layer coating solution is, in general, water, and a suitable concentration of the water-soluble polymer is 1 wt. % to 20 wt. %, preferably 2 wt. % to 10 wt. %.

Although the viscosity of each coating solution of the back layer, the intermediate layer or the polymer layer, when the viscosity of the intermediate layer coating solution or the polymer layer coating solution is extremely higher or extremely lower than the back layer coating solution, flow of superimposed back layer and polymer layer or back layer, intermediate layer and polymer layer becomes unstable, and bubbling and thickness uneveness tends to occur. Accordingly, a preferable viscosity ratio of the intermediate layer coating solution and the polymer layer coating solution to the back layer coating solution is in the range of 0.01 to 100, more preferably 0.1 to 10.

The support applicable to the invention is plastic film, resin-coated paper or the like. The material of the plastic film is polyolefin, such as polyethylene or polypropyelen, vinyl polymer, such as polyvinyl acetate, polyvinyl chloride or polystyrene, polyamide, such as 6,6-nylon or 6-nylon, polyester, such as polyethylene terephthalate, polyethylene naphthalate or polyethylene-2,6 -naphthalate, polycarbonate, cellulose acetate, such as cellulose triacetate or cellulose diacetate or the like. Optionally, an undercoat layer, such as gelatin, may be provided on the surface of the support, As the resin for coating paper of resin-coated paper, polyolefin resin, such as polyethylene is representative, but not limited thereto.

The surface of the resin-coated paper is not limited to smooth face but include a rough face having a mean surface roughness of 5 μm or less.

As mentioned previously, pH relation between the hydrophic colloid layer coating solution and the hydrophobic polymer layer coating solution is adjusted so that the electric charge of the hydrophilic colloid particles and the electric charge of the hydrophobic polymer particles have the same sign, in order to avoid loss of clarity. Each pH which satisfies the above relation can be found from the isoelectric point of the hydrophilic colloid and that of the hydrophobic polymer. If the isoelectric point is not known, the isoelectric point can be measured after making a solution of the gelatin and diotilled water and passing the solution through ion exchange membrane.

As the coating method of the back layer and the polymer layer, any method capable of forming coating solutions for a plurality of layers into film or bead and supplying continuously onto the support is utilizable, such as slide coating, extrusion coating including coextrusion and curtain coating.

In the aforementioned aspect to avoid loss of clarity, temperature difference between dry-bulb temperature and wet-bulb temperature of drying wind is 7° C. or more, preferably 15° C. or more. The temperature difference can be obtained from controlling relative humidity by increasing the moisture.

In general, a suitable temperature of drying wind is 20° C. to 50° C., preferably 25° C. to 40° C. and drying period is 0.5 min. to 10 min., preferably 1 min. to 5 min.

In order to improve water resistance of the hydrophobic polymer layer, it is preferable to store the dried support coated with the hydropholic colloid layer and the hydrophobic polymer layer at least at the glass ransition temperature −20° C. of the hydrophobic polymer, preferably at least the glass transition temperature −10° C. or higher, more preferably at least the glass transition temperature. Upper limit of the storing temperature is 50° C. preferably 40° C. from the stand point of protecting the photosensitive material from being thermably fogged. The above storing conditions are particularly effective in the case of not interposing the water-soluble polymer layer.

EXAMPLES

Example 1

The support used was a polyethylene terephthalate film 100 μm in thickness provided with a gelatin undercoat layer on both sides. A non-photosensitive hydrophilic colloid layer (back layer), a water-soluble polymer layer (intermediate layer) and a hydrophobic polymer layer (polymer layer ) having the following recipe were applied onto one side of the support by slide coating so that the back layer was located on the underside and the polymer layer was located on the upper side.

| (Back Layer Recipe) | |
|---|---|
| Gelatin | 2.5 g/m$^2$ |
| Sodium dodecylbenzenesulfonate | 10 mg/m$^2$ |
| Sodium polystyrenesulfonate | 30 mg/m$^2$ |
| N,N'-ethylene-bis-(vinylsulfonacetamido) | 25 mg/m$^2$ |

The pH of the back layer coating solution was adjusted to 5.7 by using 1N hydrochloric acid. The isoelectric point of the gelatin was pH 4.8. The temperature of the back layer coating solution was 35° C., and the viscosity was 50–60 mPa·s at a shear rate of 10/sec.

| (Intermediate Layer Recipe) | |
|---|---|
| Polyvinyl alcohol ("Kuraray Poval") (saponification degree: about 88%) (average molecular weight: about 75,000, 150,000, 350,000) | 200 mg/m$^2$ |
| Sodium dodecylbenzene sulfonate | 3 mg/m$^2$ |

The pH of the intermediate layer coating solution was adjusted to 9, which was almost the same as the polymer layer coating solution, by using 1N sodium hydroxide. The temperature of the intermediate layer coating solution was 20° C., and the viscosities of the intermediate layers respective of 75,000 150,000, 350,000 in molecular weight were 20, 33, 52 mPa·s at a shear rate of 10/sec.

| (Polymer Layer Recipe) | |
|---|---|
| Latex (methyl methacrylate:ethyl acrylate:glycidyl methacrylate:methacrylic acid = 60:32:6:2) | 2.0 g/m$^2$ |
| Sodium dodecylbenzenesulfonate | 16.5 mg/m$^2$ |
| Polymethyl methacrylate particulates | 10 mg/m$^2$ |
| $C_8F_{17}SO_3K$ | 5 mg/m$^2$ |

The hydrophobic polymer contained 6% of metahcrylic acid, and the pH was 8.8. The glass transition temperature of the hydrophobic polymer was 44° C. The temperature of the polymer layer coating solution was 20° C., and the viscosity (concentration of the polymer particulates in the coating solution was 20% by volume.) was 15 mPa·s at a shear rate of 10/sec.

The above three layers were applied onto the support in the order of the back layer, the intermediate layer and the polymer layer. As a comparison, the back layer and the polymer layer was applied onto the support in this order without interposing the intermediate layer. As the applying conditions by the slide coating, the distance between the lip of coating head and the support was 0.25 mm, and the traveling speed of the support was 150 m/min.

Subsequently, the support entered into a chilling zone, and coated layers were gelatinized by blowing wind at 20° C. as dry-bulb temperature and 15° C. as wet-bulb temperature, and then dried by blowing drying wind at 35° C. as dry-bulb temperature and 20° C. as wet-bulb temperature.

On the other side of the support, a dye layer, and emulsion layer, an under protective layer and an upper protective layer which are as disclosed in Example 3 of Japanese Patent KOKAI 5-127282 were applied by slide coating simultaneously in this order so as to locate the dye layer as the closest layer to the support. The conditions of coating, chilling and drying were the same as the case of the back layer and the polymer layer.

Several samples were prepared by coating the support as above continuously in the length of 200 m and then winding in a state of roll. Each roll was stored at 46° C. for 4 days, and then immersed in water. The thickness of the back layer and the polymer layer of each sample was measured and judged, when the thickness increase of the sum of the back layer and the polymer layer was 1 μm or less, the sample is water-resistant. The results are shown in Table 1.

TABLE 1

| | Intermediate Layer | Thickness Increase Upon Immersing in Water |
|---|---|---|
| Comparative | None | 2.8 μm |
| Comparative | PVA MW: 75,000 | 2.7 μm |
| Comparative | PVA MW: 150,000 | 2.5 μm |
| Inventive | PVA MW: 350,000 | 0.1 μm |

Example 2

The support used was a polyethylene terephthalate film 100 μm in thickness provided with a gelatin undercoat layer on both sides. A non-photosensitive hydrophilic colloid layer (back layer), a water-soluble polymer layer (intermediate layer) and a hydrophobic polymer layer (polymer layer) having the following recipe were applied onto one side of the support by slide coating so that the back layer was located on the underside and the polymer layer was located on the upper side.

| (Back Layer Recipe) | |
|---|---|
| Gelatin | 2.5 g/m$^2$ |
| Sodium dodecylbenzenesulfonate | 10 mg/m$^2$ |
| Sodium polystyrenesulfonate | 30 mg/m$^2$ |
| N,N'-ethylene-bis-(vinylsulfonacetamido) | 25 mg/m$^2$ |

The pH of the back layer coating solution was adjusted to 5.7 by using 1N hydrochloric acid. The isoelectric point of the gelatin was pH 4.8. The temperature of the back layer coating solution was 35° C., and the viscosity was 50–60 mpa·s at a shear rate of 10/sec.

| (Polymer Layer Recipe) | |
|---|---|
| Latex (methyl methacrylate:ethyl acrylate:glycidyl methacrylate:methacrylic acid = 60:32:6:2) | 2.0 g/m$^2$ |
| Sodium dodecylbenzenesulfonate | 16.5 mg/m$^2$ |
| Polymethyl methacrylate particulates | 10 mg/m$^2$ |
| $C_8F_{17}SO_3K$ | 5 mg/m$^2$ |

The hydrophobic polymer contained 6% of metahcrylic acid, and the pH was 8.8. The glass transition temperature of the hydrophobic polymer was 44° C. The temperature of the polymer layer coating solution was 20 ° C. and the viscosity (concentration of the polymer particulates in the coating solution was 20% by volume.) was 15 mPa·s at a shear rate of 10/sec.

The above two layers ware applied onto the support locating of the back layer on the support side. As the applying conditions by the slide coating, the distance between the lip of coating head and the support was 0.25 mm, and the traveling speed of the support was 150 m/min.

Subsequently, the support entered into a chilling zone, and coated layers were gelatinized by blowing wind at 20° C. as dry-bulb temperature and 15° C. as wet-bulb temperature, and then dried by blowing drying wind at 35° C. as dry-bulb temperature and 20° C. as wet-bulb temperature.

On the other side of the support, a dye layer, and emulsion layer, an under protective layer and an upper protective layer which are as disclosed in Example 3 of Japanese Patent KOKAI 5-127282 were applied by slide coating simultaneously in this order so as to locate the dye layer as the closest layer to the support. The conditions of coating, chilling and drying were the same as the case of the back layer and the polymer layer.

Several samples were prepared by coating the support as above continuously in the length of 200 m and then winding in a state of roll. Each roll was stored at a temeprature described in Table 2 with varying storing period, and then immersed in water. The thickness of the back layer and the polymer layer of each sample was measure and judged, when the thickness increase of the sum of the back layer and the polymer layer was 1 $\mu$m or less, the sample is water-resistant. Thus, the storing days necessary for appearing water-resistance was determined at each storing temperature.

The results are shown in Table 2.

TABLE 2

| | Storing Temp. | Glass Transition Temp. - Storing Temp. | Storing Days Appearing Water Resistance |
|---|---|---|---|
| Comparative | 15° C. | −29° C. | Not appear even for storing 60 days |
| Comparative | 25° C. | −19° C. | 23 days |
| Comparative | 40° C. | −4° C. | 8 days |
| Inventive | 46° C. | 2° C. | 6 days |

As can be seen from the results of Table 2, good water resistance appears by storing at a temperature not lower than the glass transition temperature (44° C.) of the hydrophobic polymer−20° C.

Example 3

The support used was a polyethylene terephthalate film 100 $\mu$m in thickness provided with a gelatin undercoat layer on both sides. A non-photosensitive hydrophilic colloid layer (back layer), a water-soluble polymer layer (intermediate layer) and a hydrophobic polymer layer (polymer layer) having the following recipe were applied onto one side of the support by slide coating so that the back layer was located on the underside and the polymer layer was located on the upper side.

| (Back Layer Recipe) | |
|---|---|
| Gelatin | 2.5 g/m$^2$ |
| Sodium dodecylbenzenesulfonate | 10 mg/m$^2$ |
| Sodium polystyrenesulfonate | 30 mg/m$^2$ |
| N,N'-ethylene-bis-(vinylsulfonacetamido) | 25 mg/m$^2$ |

The pH of the back layer coating solution was adjusted to 4.6, 5.7, 6.8 by using 1N hydrochloric acid or sodium hydroxide. The isoelectric point of the gelatin was pH 4.8. The temperature of the back layer coating solution was 35° C., and the viscosity was 50–60 mPa·s at a shear rate of 10/sec.

| (Polymer Layer Recipe) | |
|---|---|
| Latex (methyl methacrylate:styrene:2-ethylhexyl acrylate = 60:10:30) | 2.0 g/m$^2$ |
| Sodium dodecylbenzenesulfonate | 16.5 mg/m$^2$ |
| Polymethyl methacrylate particulates | 10 mg/m$^2$ |
| $C_8F_{17}SO_3K$ | 5 mg/m$^2$ |

The hydrophobic polymer contained 0.1% of crylic acid, and the pH was 9.8. Accordingly, in the case of the back layers of pH 5.7 and pH 6.8, the electric charge of gelatin which was the binder was negative similar to the electric charge of the polymer particulates in the polymer layer. The temperature of the polymer layer coating solution was 20° C., and the viscosity (concentration of the polymer particulates in the coating solution was 20% by volume.) was 11 mPa·s at a shear rate of 10/sec.

As the applying conditions by the slide coating, the distance between the lip of slit coating head and the support was 0.25 mm, and the traveling speed of the support was 150 m/min.

Subsequently, the support entered into a chilling zone, and coated layers were gelatinized by blowing wind at 20° C. as dry-bulb temperature and 15° C. as wet-bulb temperature, and then dried under several conditions as shown in Table 3.

On the other side of the support, a dye layer, and emulsion layer, an under protective layer and an upper protective layer which are as disclosed in Example 3 of Japanese Patent KOKAI 5-127282 were applied by slide coating simultaneously in this order so as to locate the dye layer as the closest layer to the support.

After applying, coated layers were gelatinized by blowing wind at 20° C. as dry-bulb temperature and 15° C. as wet-bulb temperature, and then dried by blowing drying wind at 35° C. as dry-bulb temperature and 20° C. as wet-bulb temperature for 150 seconds.

Opacity (absorbance of white light) of each sample was measured, and the results are shown in Table 3. Allowance of the white light is 2%.

TABLE 3

| | Drying Conditions | | Back | White |
|---|---|---|---|---|
| | Dry-Bulb Temp. - Wet-Bulb Temp. | Drying Time | Layer pH | Light Absorbance |
| Comparative | 5° C. | 190 | 4.6 | 6.0% |
| Comparative | 5° C. | 190 | 5.7 | 2.6% |
| Comparative | 5° C. | 190 | 6.8 | 2.6% |
| Comparative | 7° C. | 140 | 4.6 | 4.9% |
| Inventive | 7° C. | 140 | 5.7 | 1.8% |
| Inventive | 7° C. | 140 | 6.8 | 1.9% |
| Comparative | 15° C. | 65 | 4.6 | 4.2% |
| Inventive | 15° C. | 65 | 5.7 | 1.4% |
| Inventive | 15° C. | 65 | 6.8 | 1.2% |
| Comparative | 20° C. | 50 | 4.6 | 3.3% |
| Inventive | 20° C. | 50 | 5.7 | 1.2% |

It should be understood that the foregoing relates to only a preferred embodiment of the invention, and that it is intended to cover all changes and modifications of the examples of the invention herein chosen for the purposes of the disclosure, which do not constitute departures from the spirit and scope of the invention.

We claim:

1. A silver halide photographic photosensitive material which comprises a support, a silver halide photographic emulsion layer coated on one side of the support, and a non-photosensitive hydrophilic colloid layer and a hydrophobic polymer layer coated on the other side of the support locating the hydrophobic polymer layer on the outside, wherein a layer of water-soluble polymer having an average molecular weight of 300,000 or more is interposed between the non-photosensitive hydrophilic colloid layer and the hydrophobic polymer layer.

2. The silver halide photographic photosensitive material of claim 1 wherein the average molecular weight of the water-soluble polymer is 300,000 to 1,000,000.

3. The silver halide photographic photosensitive material of claim 1 wherein the average molecular weight of the water-soluble polymer is 300,000 to 500,000.

4. The silver halide photographic photosensitive material of claim 1 wherein the water-soluble polymer is a member selected from the group consisting of water-soluble synthetic polymers, polyvinylamine derivative, polyvinyl pyrrolidone, natural polymers, and starch derivatives.

5. The silver halide photographic photosensitive material of claim 1 wherein the water-soluble polymer is polyvinyl alcohol or polyacrylamide.

6. The silver halide photographic photosensitive material of claim 1 wherein binder of the non-photosensitive hydrophilic colloid layer consists essentially of gelatin, and dry thickness of said colloid layer is 0.5 to 10 $\mu$m.

7. The silver halide photographic photosensitive material of claim 1 wherein dry thickness of the hydrophobic polymer layer is 0.5 to 10 $\mu$m.

8. A method of producing a silver halide photographic photosensitive material which comprises applying a silver halide photographic emulsion layer coating solution containing hydrophilic colloid as binder onto one side of a support and applying a non-photosensitive hydrophilic colloid layer coating solution containing hydrophilic colloid as binder and a hydrophobic polymer layer simultaneously on the other side, wherein a layer of water-soluble polymer having an average molecular weight of 300,000 or more is interposed between the non-photosensitive hydrophilic colloid layer and the hydrophobic polymer layer.

9. The silver halide photographic photosensitive material of claim 1 wherein the water-soluble polymer is a member selected from the group consisting of hydroxyethyl cellulose and carboxymethyl cellulose.

* * * * *